US010344464B2

(12) United States Patent
Hashimoto et al.

(10) Patent No.: US 10,344,464 B2
(45) Date of Patent: Jul. 9, 2019

(54) FLUSH TOILET

(71) Applicant: TOTO LTD., Kitakyushu-shi, Fukuoka (JP)

(72) Inventors: Hiroshi Hashimoto, Kitakyushu (JP); Shinichi Urata, Kitakyushu (JP); Shuichi Nagashima, Kitakyushu (JP); Mayu Okubo, Kitakyushu (JP); Shoko Imaizumi, Kitakyushu (JP); Daisuke Yamamoto, Kitakyushu (JP); Kenichi Nakamura, Kitakyushu (JP); Takumi Tsuchitani, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/697,741

(22) Filed: Sep. 7, 2017

(65) Prior Publication Data

US 2018/0080208 A1 Mar. 22, 2018

(30) Foreign Application Priority Data

Sep. 16, 2016 (JP) ..... 2016-181420

(51) Int. Cl.
*E03D 11/08* (2006.01)

(52) U.S. Cl.
CPC ..... *E03D 11/08* (2013.01); *E03D 2201/30* (2013.01); *E03D 2201/40* (2013.01)

(58) Field of Classification Search
CPC ..... E03D 11/08
See application file for complete search history.

(56) References Cited

U.S. PATENT DOCUMENTS

2010/0186158 A1 7/2010 Morita et al.
2015/0275494 A1 10/2015 Kashirajima et al.
2016/0222641 A1* 8/2016 Urata ..... E03D 11/08

FOREIGN PATENT DOCUMENTS

JP 3817734 B2 9/2006
JP 2015-068126 A 4/2015
JP 2015-196960 A 11/2015
TW I449831 B 8/2014

OTHER PUBLICATIONS

The extended European search report issued by the European Patent Office dated Mar. 6, 2018, which corresponds to European Patent Application No. 17189341.5-1002 and is related to U.S. Appl. No. 15/697,741.

* cited by examiner

*Primary Examiner* — Janie M Loeppke
(74) *Attorney, Agent, or Firm* — Studebaker & Brackett PC

(57) ABSTRACT

The present invention is a flush toilet (1) including: a bowl portion (8) having a bowl-shaped waste receiving surface (16), a rim portion (18), and a well portion (20) formed at the bottom of the waste receiving surface; a discharge trap pipe (12) connected to the bottom portion of the well portion; a flush water guide portion (40*b*) disposed on the waste receiving surface at the rear of the well portion so that flush water is directed toward the side wall surface inside the well portion; and a liquid membrane spouting portion (24) disposed on the rim portion, wherein this liquid membrane spouting portion induces a vertical circulating flow in the well portion, produced when discharged flush water assumes a liquid membrane form and collides with a flush water guide portion, and the colliding flush water drops along the side wall surface of the well portion.

8 Claims, 8 Drawing Sheets

FLUSH TOILET

TECHNICAL FIELD

The present invention pertains to a flush toilet, and more particularly to a flush toilet in which flush water flushes the toilet and discharges waste.

BACKGROUND ART

A flush toilet is described in Japanese Patent 3817734 (Patent Document 1). In the flush toilet set forth in Patent Document 1, a horizontal circulating flow is induced by the discharge of flush water in the horizontal direction from a rim spout port disposed on the top edge of the bowl portion which receives waste, and the entire bowl surface is flushed by this circulating flow.

There is also a flush toilet set forth in Japanese Published Unexamined Patent Application 2015-196960 (Patent Document 2). In the flush toilet set forth in Patent Document 1, a horizontal circulating flow is induced by the discharge of flush water in the horizontal direction from a rim spout port disposed on the top edge of the bowl portion which receives waste, and the entire bowl surface is flushed by this circulating flow. In addition, in this flush toilet a guiding portion for directing the flow of flush water circulating in the bowl portion to flow toward the bottom surface of the bowl portion is disposed in the rear region of the bowl portion, and this guiding portion forms a flow for stirring accumulated water inside the bowl portion in the up-down direction.

PRIOR ART REFERENCES

Patent Documents

Patent Document 1: Japanese Patent No. 3817734

Patent Document 2: Japanese Patent Laid Open No. 2015-196960

SUMMARY OF THE INVENTION

Problems the Invention Seeks to Resolve

In the flush toilet set forth in Patent Document 1, the horizontal circulating flow produced by flush water discharged from the rim spout port into the bowl portion results in a strong capability to flush the surface of the bowl. However this flush toilet has the problem that its ability to submerge waste floating on the accumulated water and discharge waste to the discharge trap connected to the bottom portion of the bowl portion is low. This type of problem is particularly prominent in flush toilets without a jet spout port for producing a flow to push accumulated water in the bowl portion into the discharge trap pipe.

In the flush toilet of Patent Document 2, on the other hand, a guide portion is provided to produce a flow for stirring accumulated water in the up-down direction, enabling a submerging effect on waste floating in the accumulated water. However in the flush toilet of Patent Document 2, as well, flush water which has circulated over the bowl surface as a linear flow from a rim spout port is caused by the guide portion to flow into the accumulated water, therefore a horizontal circulating component remains as before in the flush water, and the ability to stir accumulated water in the up-down direction is poor. In addition, the water force of flush water which has circulated over the bowl surface is weak even if made to flow into the accumulated water by the guide portion, and its ability to stir accumulated water is insufficient. Therefore in the flush toilet of Patent Document 2, while it is true that the effect of submerging waste floating in accumulated water is observed, that effect is insufficient, and there is a risk that sufficient discharge capability will not be achieved, particularly when water conservation efforts advance and the total volume of flush water diminishes.

The present invention was undertaken to resolve the above problems, and has the object of providing a flush toilet capable of effectively discharging waste floating in accumulated water.

Means for Resolving Problems

In order to resolve the above-described problems, the present invention is a flush toilet flushed by flush water and discharging waste, comprising: a bowl portion including a bowl-shaped waste receiving surface, a rim portion formed on an upper portion of the waste receiving surface, and a well portion formed below the waste receiving surface for storing an accumulated water; a discharge trap pipe connected so as to communicate with a bottom portion of the well portion, thereby discharging the flush water and the waste; a flush water guide portion formed on the waste receiving surface at a rear of the well portion so that the flush water supplied to the bowl portion is guided toward a side wall surface on an inside of the well portion; and a liquid membrane spouting portion formed on the rim portion; wherein the liquid membrane spouting portion discharges the flush water in a liquid membrane form so that the discharged flush water collides with the flush water guide portion to induce a vertical circulating flow in the accumulated water of the well portion, by dropping the flush water along the side wall surface of the well portion.

In the invention thus constituted, flush water is discharged from the liquid membrane spouting portion disposed on the rim portion formed on the top portion of the waste receiving surface; the discharged flush water assumes a liquid membrane form and collides with the flush water guide portion, and the colliding flush water drops along the side wall surface of the well portion. The dropping of flush water along the side wall portion of the well portion induces a vertical circulating flow in the accumulated water in the well portion; waste floating in the accumulated water is submerged into the accumulated water in the well portion and discharged together with flush water from the trap conduit connected to the bottom portion of the well portion.

In the invention thus constituted, flush water discharged from the liquid membrane spouting portion a liquid membrane form collides with the flush water guide portion and drops into the well portion, inducing a vertical circulating flow in the accumulated water, therefore waste floating in the accumulated water can be efficiently submerged in the accumulated water, and floating waste can be effectively discharged from the bowl portion.

In the present invention, preferably, the flush water guide portion is a stepped portion formed on the waste receiving surface so as to be smoothly continuous with a ridge line of the well portion.

In the invention thus constituted, the flush water guide portion is constituted by a stepped portion smoothly connected to the well portion ridge line, therefore flush water colliding with the flush water guide portion can be efficiently made to flow into the well portion, and a strong vertical circulating flow can be induced in the well portion without significant loss of force in the flush water discharged from the liquid membrane spouting portion. Waste floating in the accumulated water can thus be efficiently submerged and discharged.

In the present invention, preferably, the flush water guide portion is configured such that a slope of the stepped portion in a circumferential direction of the waste receiving surface is most gradual in an outermost circumference of the waste receiving surface, and becomes steep as it approaches the well portion.

In the invention thus constituted, the slope of the stepped portion forming the flush water guide portion is most gradual at the outermost circumference of the water reservoir and becomes steeper approaching the well portion, therefore the flush water in a liquid membrane state colliding with the flush water guide portion can be made to retain that shape as it flows into the well portion, and a stronger vertical circulating flow can be induced in the accumulated water within the well portion.

In the present invention, preferably, the flush water guide portion is configured such that a step difference of the stepped portion is smallest at the outermost circumference of the waste receiving surface, and is largest approaching the well portion.

In the invention thus constituted, the step difference of the stepped portion forming the flush water guide portion is smallest at the outermost circumference of the waste receiving surface and is made to increase toward the well portion, so the majority of flush water colliding with the flush water guide portion can be directed to the well portion, and a strong vertical circulating flow can be induced in the accumulated water in the well portion.

In the present invention, preferably, the waste receiving surface has a concave portion which is formed in a rear portion of the waste receiving surface and is connected to the well portion, and one of end portions of the concave portion functions as the flush water guide portion on which the flush water collides.

In the invention thus constituted, a concave portion connecting with the well portion is formed at the rear portion of the waste receiving surface, and one of the edge portions on this concave portion functions as a flush water guide portion, so that flush water colliding with the flush water guide portion immediately drops into the concave portion and flows into the well portion connected to the concave portion. Therefore the majority of flush water discharged as a liquid membrane from the liquid membrane spouting portion can be made to flow into the well portion over a relatively short path, and a strong vertical circulating flow can be induced in the well portion. Waste floating in the accumulated water can thus be efficiently submerged and discharged.

In the present invention, preferably, the concave portion formed in the waste receiving surface lies from the well portion of the bowl portion to a rear end of the bowl portion.

In the invention thus constituted, a concave portion is formed from the well portion to the rear edge of the bowl portion, therefore flush water flowing along the rear edge of the bowl portion collides with one edge portion of the concave portion (the flush water guide portion) and drops into the concave portion. As a result, the majority of flush water discharged as a liquid membrane from the liquid membrane spouting portion can be made to flow into the well portion by the flush water guide portion, and a strong vertical circulating flow can be induced in the well portion. Waste floating in the accumulated water can thus be efficiently submerged and discharged.

In the present invention, preferably, the concave portion formed in the waste receiving surface has approximately a fan shape, broadening toward the rear of the bowl portion.

In the invention thus constituted, the indentation is formed in essentially a fan shape widening toward the rear of the bowl portion, therefore the majority of flush water discharged in a liquid membrane state from the liquid membrane spouting portion and flowing to the rear portion of the bowl portion can be collected at the center of the indented portion, and the collected flush water can be made to flow in a concentrated manner into the well portion. As a result, a vertical circulating flow can be induced in the well portion, and waste floating in the accumulated water can be submerged and discharged.

In the present invention, preferably, the liquid membrane spouting portion forms the flush water into the liquid membrane form by discharging the supplied flush water to follow a downward sloped surface descending downward in the direction of the flush water discharged from the liquid membrane spouting portion.

In the invention thus constituted, the liquid membrane spouting portion forms flush water into a liquid membrane shape by discharging it along a downward sloped surface descending in the direction of flush water discharge, therefore discharged flush water can be efficiently placed into a liquid membrane form. Liquid membrane-shaped flush water is capable of inducing a strong vertical circulating flow upon flowing into the well portion, so that waste floating in the accumulated water can be submerged and discharged.

In the present invention, preferably, the liquid membrane spouting portion is disposed at the rear of the bowl portion so as to oppose the flush water guide portion.

In the invention thus constituted, the liquid membrane spouting portion is disposed at the rear of the bowl portion so as to oppose the flush water guide portion, therefore flush water discharged from the liquid membrane spouting portion collides with the flush water guide portion at close range. Flush water discharged from the liquid membrane spouting portion therefore flows into the well portion with the strong discharge force essentially maintained. As a result, a vertical circulating flow can be induced in the well portion, and waste floating in the accumulated water can be submerged and discharged.

In the present invention, preferably, the liquid membrane spouting portion is disposed on the inside of a region in which the concave portion of the waste receiving surface is formed.

In the invention thus constituted, the liquid membrane spouting portion is disposed on the inside of the region in which the concave portion of the waste receiving surface is formed, therefore the majority of flush water discharged from the liquid membrane spouting portion can be dropped into the concave portion, and flush water which has fallen into the concave portion can be made to flow into the well portion by the guide portion. A large volume of flush water can thus be made to flow into the well portion at once, so that a strong vertical circulating flow is induced in the well portion, and waste floating in the accumulated water can be efficiently submerged and discharged.

In the present invention, preferably, there is furthermore a rim spout portion disposed on the rim portion, wherein the rim spout portion discharges the flush water to form a horizontal circulating flow on the waste receiving surface.

In the invention thus constituted, a rim spout portion forming a circulating flow in the horizontal direction on the waste receiving surface using discharged flush water is provided separately from the liquid membrane spouting portion, therefore waste adhering to the waste receiving surface can be effectively washed off, and the entire bowl portion can be effectively flushed.

Effect of the Invention

Using the flush toilet of the present invention, waste floating in accumulated water can be effectively discharged.

A plan view cross section showing a flush toilet according to an embodiment of the present invention.

FIG. 2

Figure 1:
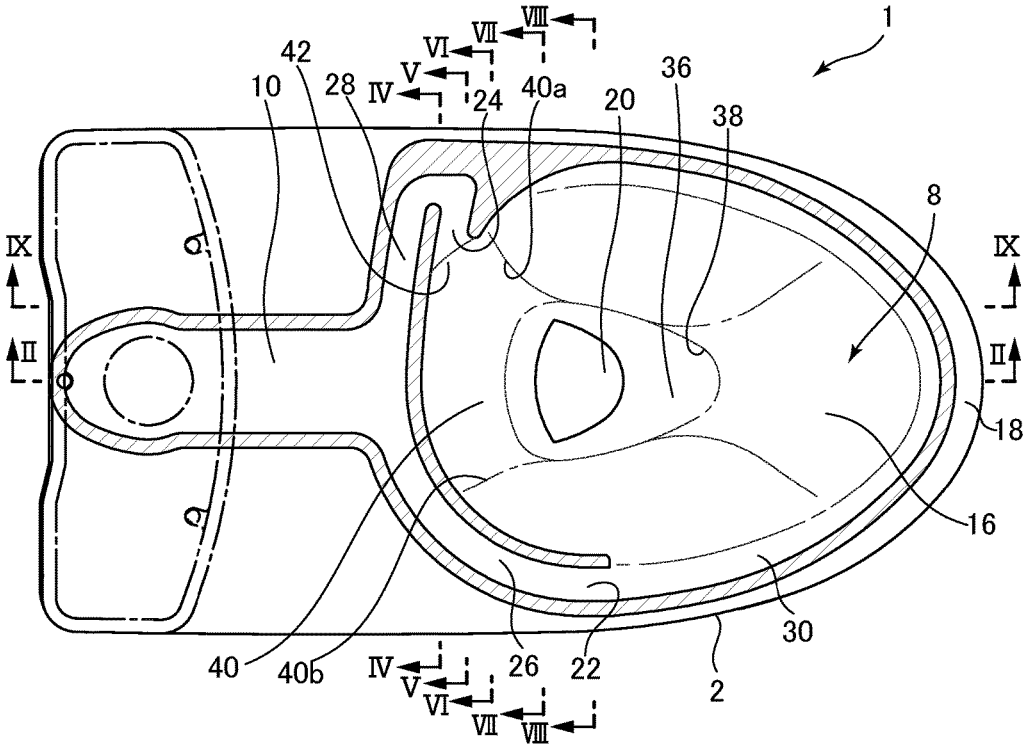
FIG. 1

A cross section seen along line II-II in FIG. 1 of a flush toilet according to an embodiment of the invention.

FIG. 3

A perspective view showing the state whereby a flush toilet according to an embodiment of the invention is cut along a vertical plane extending in the left-right direction.

FIG. 4

A cross section cut along line IV-IV in FIG. 1 of a flush toilet according to an embodiment of the invention.

FIG. 5

A cross section cut along line V-V in FIG. 1 of a flush toilet according to an embodiment of the invention.

FIG. 6

A cross section cut along line VI-VI in FIG. 1 of a flush toilet according to an embodiment of the invention.

FIG. 7

A cross section cut along line VII-VII in FIG. 1 of a flush toilet according to an embodiment of the invention.

FIG. 8

A cross section cut along line VIII-VIII in FIG. 1 of a flush toilet according to an embodiment of the invention.

FIG. 9

A cross section cut along line IX-IX in FIG. 1 of a flush toilet according to an embodiment of the invention.

FIG. 10

A simplified plan view showing the appearance of flush water flow in a toilet according to an embodiment of the invention.

FIG. 11

A simplified cross section showing the appearance of flush water flow in a toilet according to an embodiment of the invention.

EMBODIMENTS OF THE INVENTION

Next, referring to FIGS. 1 through 11, we explain a flush toilet according to an embodiment of the invention.

Figure 2:
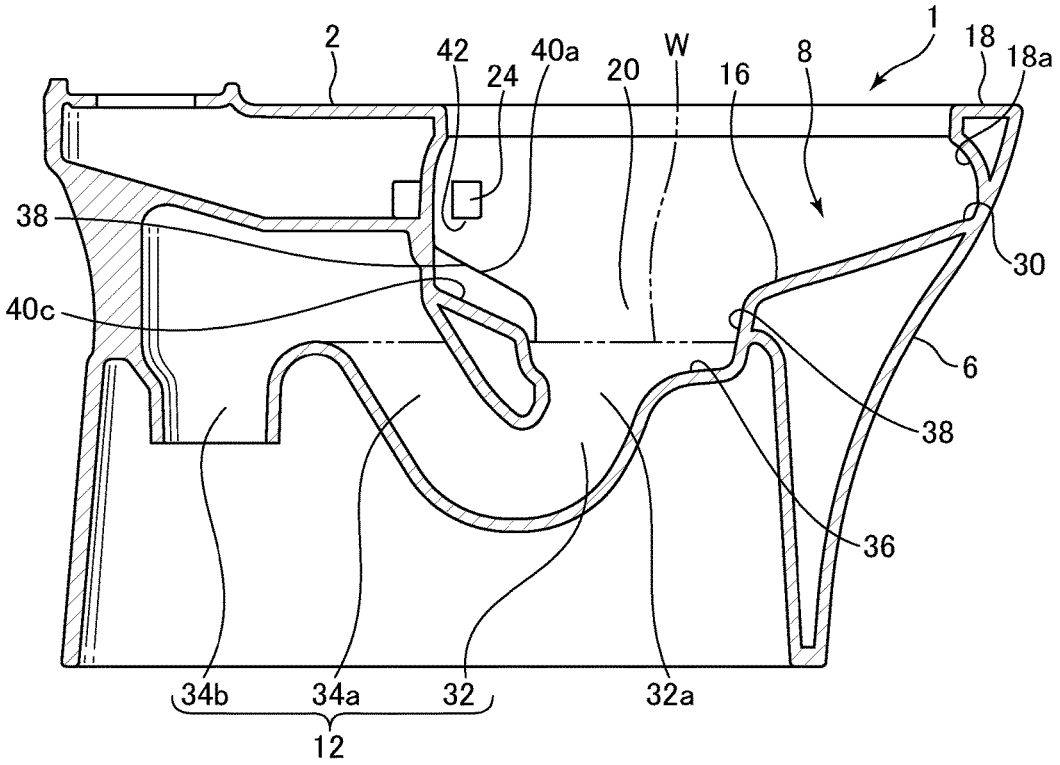

First, referring to FIGS. 1 and 2, we explain a flush toilet according to an embodiment of the invention. FIG. 1 is a plan view cross section showing a flush toilet according to an embodiment of the present invention; FIG. 2 is a cross section seen along line II-II in FIG. 1.

As shown in FIGS. 1 and 2, the flush toilet 1 of the present embodiment is a wash-down type of toilet in which waste is pushed out by the flow action resulting from the water drop within the bowl portion, and comprises a toilet main body 2; flush water is introduced into this toilet main body 2 via a reservoir tank (not shown) serving as the flush water source. The toilet main body 2 is made of glazed ceramic; a skirt portion 6 is formed on the bottom portion thereof, and a bowl portion 8 is formed at the front on the upper half thereof. A shared water passageway 10 connected to a discharge port on the reservoir tank (not shown) is formed at the rear upper portion of the bowl portion 8; in addition, a discharge trap pipe 12 for discharging waste is formed at the rear lower portion of the bowl portion 8.

The present invention, without limitation to flush toilets comprising reservoir tanks, can also be applied to flush toilet in which flush water is supplied using a jet pump mechanism, or direct pressure-type flush toilets in which flush water is directly supplied.

The bowl portion 8 comprises a bowl-shaped waste receiving surface 16, a rim portion 18 positioned on the top edge thereof, and a well portion 20, formed below the waste receiving surface 16. Here, as shown in FIG. 2, the rim portion 18 inside circumferential surface 18*a* has an overhanging shape toward the inside, so that flush water circulating in the horizontal direction, described below, does not splash to the outside.

A first rim spout port 22 is formed at the center portion on the left side as seen from the front of the inside circumferential surface of the bowl portion 8 rim portion 18, and a second rim spout port 24, being a liquid membrane spouting portion, is formed on the right rear side (downstream side) as seen from the front thereof. This first rim spout port 22 and second rim spout port 24 are oriented so as to discharge flush water in the same direction on a horizontal plane (the counterclockwise direction in FIG. 1), and flush water discharged from the first rim spout port 22 forms a circulating flow circulating in the horizontal direction on the waste receiving surface 16.

The shared water passageway 10 formed on the rear upper portion of the flush toilet 1 described above branches into a second water passageway 28 for supplying flush water to the first rim spout port 22 and a second water passageway 28 for supplying flush water to the second rim spout port 24.

Note that in the flush toilet 1 of the present embodiment, the first water passageway 26 including the first rim spout port 22, and the second water passageway 28 including the second rim spout port 24 are formed integrally with the ceramic toilet main body 2, but the present invention is not limited to such forms, and the present invention may also be formed by a distributor or the like separate from a first water passageway including the first rim spout port and a second water passageway including the second rim spout port.

In addition, as shown in FIG. 2, a shelf-shaped water conduit 30 for guiding flush water is formed in the bottom region of the inside circumferential surface 18*a* of the bowl portion 8 rim portion 18. Note that this water conduit 30 is also the external circumferential edge region of the waste receiving surface 16. The water conduit 30 causes flush water spouted from the first rim spout port 22 to circulate along the rim portion 18 inside circumferential surface 18*a* to the rear end portion of the waste receiving surface 16.

Next, as shown in FIG. 2, a discharge trap pipe 12 is formed by an introducing pipe 32 connected to the well portion 20 bottom surface 36 and extending rearward and downward, and by an ascending pipe path 34*a* and a descending pipe path 34*b*.

This introducing pipe 32 is connected as a smooth continuous curved surface to the bottom surface 36 of the well portion 20, and is arranged so that flush water flowing into the introducing pipe 32 from the well portion 20 flows smoothly inside the introducing pipe 32.

Next, as shown in FIGS. 1 and 2, the bowl portion 8 well portion 20, as described above, comprises a bottom surface 36 positioned below the accumulated water level W, and a side wall surface 38 for connecting this bottom surface 36 with the bottom edge portion of the waste receiving surface 16. This bottom surface 36 is formed in a region in front of the introducing pipe 32 inlet 32*a*, and is formed to be approximately horizontal. This bottom surface 36 may also be sloped downward toward the rear. At the rear of the well portion 20, no bottom surface 36 is formed, but a side wall surface 38 is formed; this side wall surface 38 is formed continuously with the introducing pipe 32 inlet 32*a*.

In addition, as shown in FIG. 1, an approximately fan-shaped concave portion 40, widening toward the rear of the bowl portion 8, is formed in the region at the rear portion of the waste receiving surface 16 between the 20 and the rear end portion of the bowl portion 8 (the rear edge portion of the waste receiving surface 16), so as to connect with the well portion 20. Thus by forming a concave portion 40 on the waste receiving surface 16, stepped portions 40*a*, 40*b* are respectively formed at both ends of the concave portion 40, and these stepped portions 40*a*, 40*b* smoothly continue the ridge line of the well portion 20. In the present embodiment the second rim spout port 24 is disposed on the rear right side of the bowl portion 8 as seen from the front of the flush toilet 1, and discharges flush water to the left, therefore of the concave portion 40 stepped portions 40*a*, 40*b*, the stepped portion 40*b* (in this embodiment, the left side stepped portion) is oriented so as to face the second rim spout port 24. Therefore in the present embodiment the stepped portion 40*b*, oriented so as to face the second rim spout port 24, functions as a flush water guide portion so that flush water discharged from the second rim spout port 24 collides with it, and colliding flush water is made to drop down along the side wall surface 38 of the well portion 20. The stepped portion 40*b* is formed so that its angle increases toward the well portion and becomes deeper, so that when guiding a flush, spout water can be directed in a liquid membrane form toward the well portion. Thus flush water colliding with the flush water guide portion (stepped portion 40*b*) and dropping along the 20 side wall surface 38 induces a vertical circulating flow. Note that in the present embodiment the minimum distance between the second rim spout port 24 and the left side stepped portion 40*b* is approximately 160 mm, and preferably between approximately 130 mm and approximately 200 mm.

Next, referring to FIGS. 3 through 9, we explain the constitution of the flush water guide portion and the second rim spout port in further detail.

Figure 3:
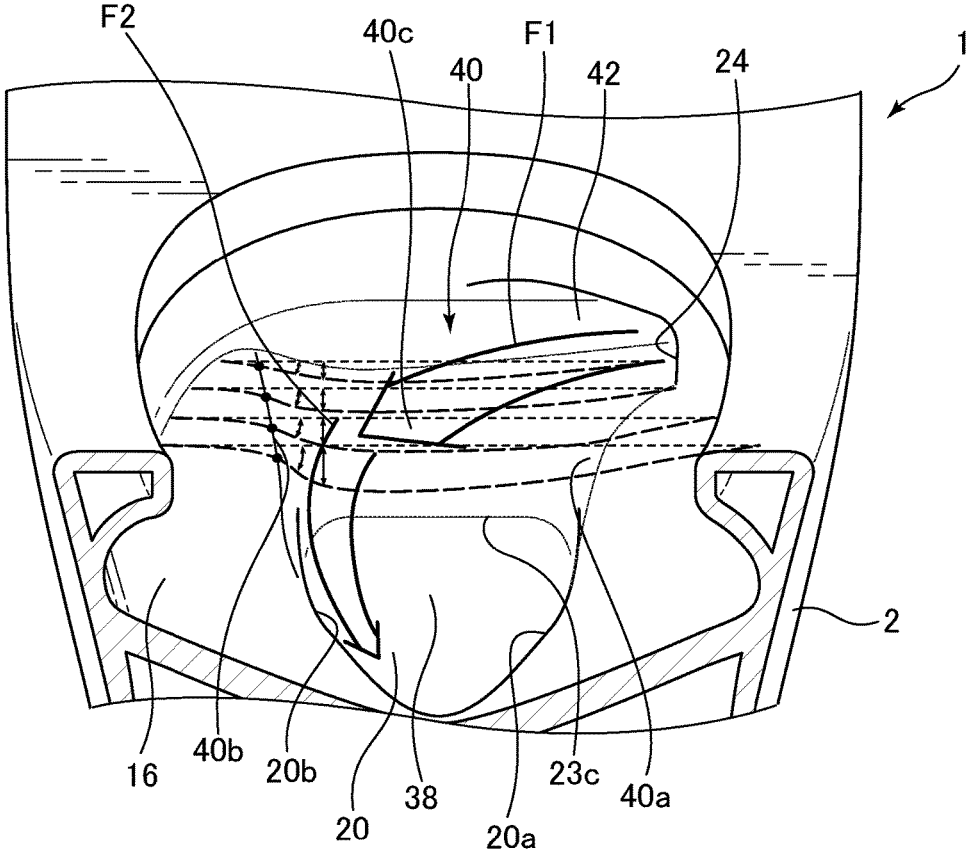
Figure 4:
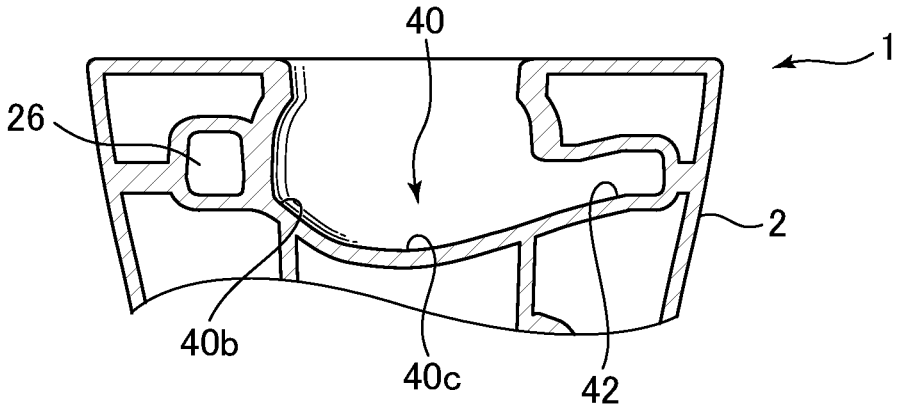
Figure 5:
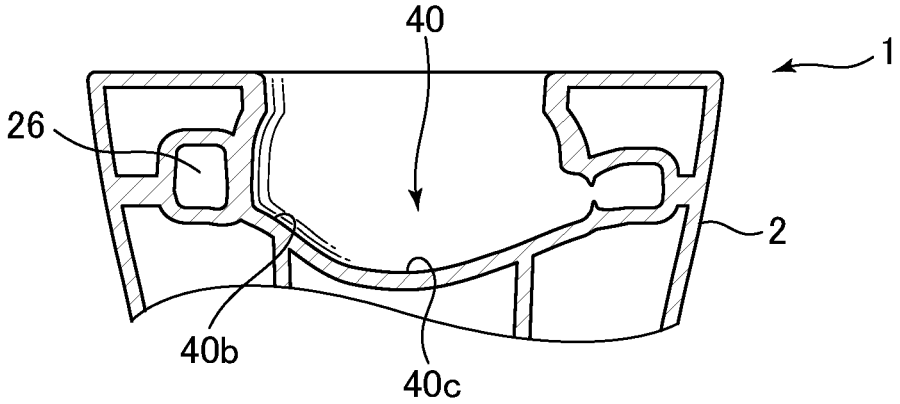
Figure 6:
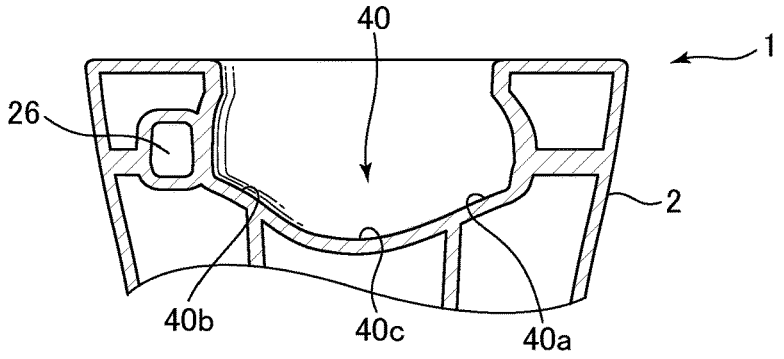
Figure 7:
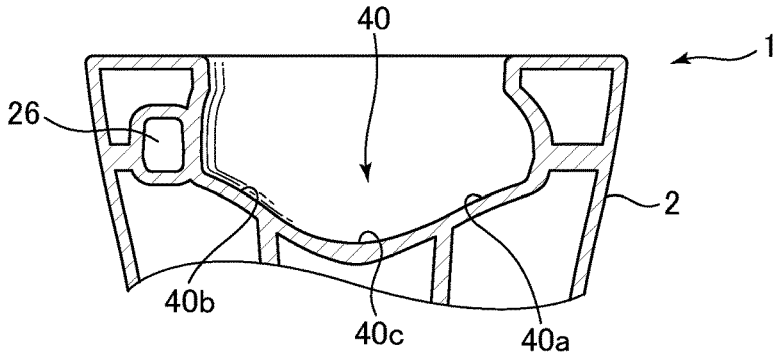

FIG. 3 is a perspective view showing the state whereby the flush toilet 1 is cut along a vertical plane extending in the left-right direction thereof. FIGS. 4 through 8 are cross sections in which the flush toilet 1 is cut along lines IV-IV through lines VIII-VII in FIG. 1. In addition, FIG. 9 is a cross section cut through the flush toilet 1 along line IX-IX in FIG. 1.

As shown in FIG. 3, the stepped portions 40*a*, 40*b* on both sides, formed by disposing the concave portion 40 on the waste receiving surface 16, are smoothly continuous with the side portion ridge lines 20*a*, 20*b* (the lines in which the side wall surfaces 38 on both side portions of the well portion 20 and the inside circumference of the waste receiving surface 16 intersect). The well portion 20 rear side top edge and the concave portion 40 bottom surface 40*c* also smoothly intersect, forming a rear portion ridge line 20*c* on the rear side of the well portion 20. The ridge in the left-right direction of the concave portion 40 is narrowest on the rear portion ridge line 20*c* of the well portion 20, widening toward the rear, and is widest at the rear end portion of the waste receiving surface 16. Stated differently, the gap in the left-right direction between the stepped portions 40*a* and 40*b* is greatest at the rear end portion, and is smallest at the connecting portion between the side portion ridge lines 20*a*, 20*b* of the toilet main body 2. The bottom surface 40*c* of the concave portion 40 is sloped so as to drop from the waste receiving surface 16 rear end portion toward the well portion 20, and the depth of the concave portion 40 is shallowest at the rear end portion of the waste receiving surface 16 and deepest at the rear portion ridge line 20*c* of the well portion 20. I.e., the stepped portions 40*a*, 40*b* have the smallest step difference (level difference) at the rear end portion of the waste receiving surface 16 (the outermost circumference of the waste receiving surface 16), and the step difference increases approaching the well portion 20.

Note that in the present embodiment the width at the front end portion of the 40 (the part connecting with the well portion 20) is approximately 115 mm, and is formed to be approximately the same as the maximum width of the well portion 20. Also, the rear end portion of the concave portion 40 (the part contacting the rim portion 18 inside circumferential surface 18*a*) is approximately 195 mm. Preferably, the width at the rear end portion of the concave portion is formed to be approximately 100 mm to 240 mm, and the concave portion is formed with a center angle relative to the center of the well portion of between approximately 38° and approximately 110°. In addition, in the present embodiment the depth of the concave portion 40 is formed to be approximately 18 mm at the deepest portion, and preferably the depth at the deepest portion is approximately 10 mm to 30 mm.

Figure 8:
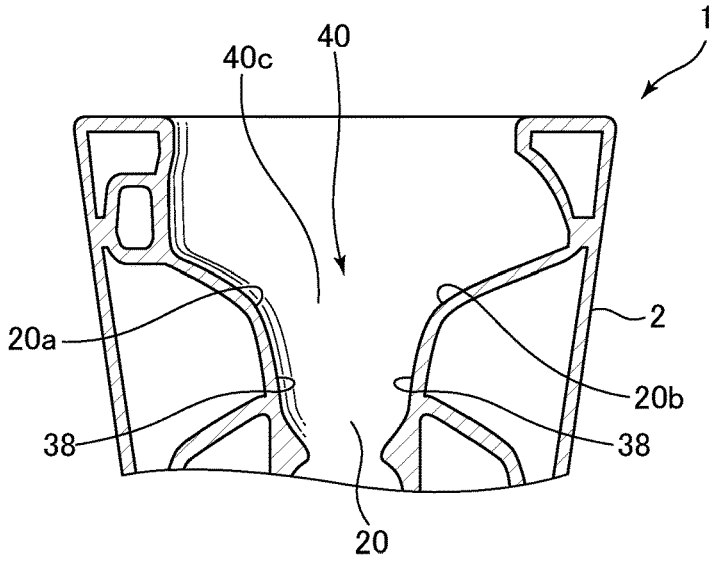
Figure 9:
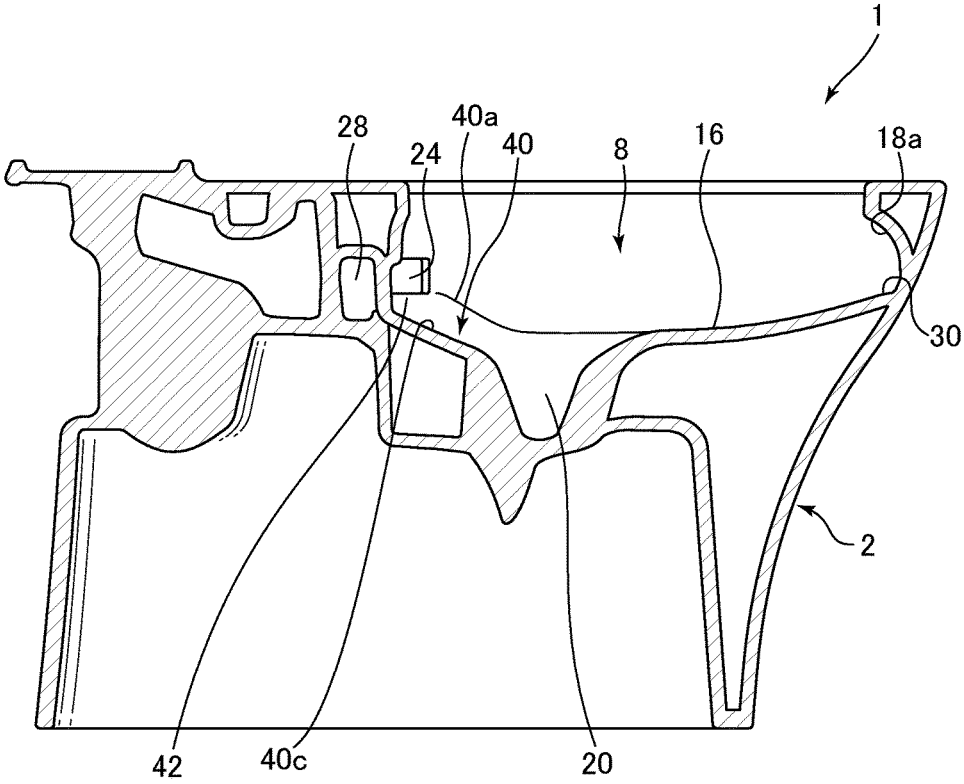

Furthermore, as shown in FIGS. 4 through 8, the sloped surface angle in the left-right direction of the sloped surface facing from the concave portion 40 stepped portions 40*a*, 40*b* toward the bottom surface 40*c* (the sloped surface angle in the circumferential direction of the waste receiving surface 16) is most gradual in the rear end portion of the waste receiving surface 16 (the outermost circumference of the waste receiving surface 16), and the slope gradually steepens approaching the well portion 20. I.e., the left-right direction slope of the sloped surface connecting the waste receiving surface 16 and the concave portion 40 bottom surface 40*c* is most gradual in the rear end portion of the waste receiving surface 16 (FIG. 4), and the left-right direction slope thereof is steepest in the front end portion of the bottom surface 40*c* (FIG. 8). Note that in the present embodiment the slope angle of the slope in the left-right direction heading from the stepped portion 40*b* to the bottom surface 40*c* is formed to be approximately 15° at its maximum, and the maximum slope angle is preferably approximately 5° to approximately 20°.

Next, referring to FIGS. 1, 3, and 9, we explain the constitution of the first rim spout port 22, being a rim spout portion, and the second rim spout port 24, being a liquid membrane spouting portion.

First, as shown in FIG. 1, the first rim spout port 22, being a rim spout portion, is disposed on the left side portion of the bowl portion 8, and flush water discharged from the first rim spout port 22 is directed by a water conduit 30 provided on the outside circumferential portion of the waste receiving surface 16. I.e., the floor of the first rim spout port 22 and the outer surface of the water conduit 30 are generally continuous, and flush water discharged from the first rim spout port 22 is placed on the approximately horizontally formed water conduit 30 to be guided. Flush water guided along the water conduit 30 flows down a little at a time over the waste receiving surface 16, forming a counterclockwise horizontal circulating flow on the waste receiving surface 16, flowing into the well portion 20, thereby flushing the waste receiving surface 16.

On the other hand the second rim spout port 24, being a liquid membrane spouting portion, is formed on the inside of the region in which a concave portion is disposed at the right rear end portion of the bowl portion 8, as shown in FIG. 3. The bottom surface of the second water passageway 28 is a downward slope from the vicinity of the second rim spout port 24 toward the discharge direction, and this sloped surface is smoothly continuous with the concave portion 40 bottom surface 40*c*, forming a downward sloped surface 42 toward the well portion 20. I.e., whereas flush water discharged from the first rim spout port 22 is guided by the approximately horizontal water conduit 30, which is essentially continuous with the floor of the first rim spout port 22, no approximately horizontal guide path continuous with the floor is provided on the second rim spout port 24, and flush water from the second rim spout port 24 is discharged along the downward sloped surface 42, which is essentially continuous with the floor of the second rim spout port 24, and slopes downward toward the direction in which flush water is discharged.

Thus when flush water is discharged along the downward sloped surface 42, it flows diagonally downward while spreading in a liquid membrane form so as to adhere to the downward sloped surface 42 due to gravity and the Coander effect (FIG. 3, arrow F1), colliding with the left side stepped portion 40*b* (the flush water guide portion), disposed opposite the second rim spout port 24. I.e., flush water discharged along the approximately horizontal water conduit 30 from the first rim spout port 22 flows as a liquid membrane on the water conduit 30, and rather than flowing down a little at a time on the waste receiving surface 16, the flush water discharged from the second rim spout port 24 to the downward sloped surface 42 assumes a liquid membrane form and flows diagonally downward from the second rim spout port 24. In the present embodiment the slope in the direction spouted from the second rim spout port 24 (the circumferential direction of the waste receiving surface 16) forms the discharged flush water into a liquid membrane form by discharging it along the downward sloped surface 42 at an approximately 13° slope angle. Note that flush water can be formed into a liquid membrane by discharging flush water along a downward sloped surface at a slope angle of 5° to 20°. Discharged flush water is also formed into a liquid membrane form by use of a flat cross sectional shape for the rim spout port.

Flush water flowing diagonally downward from the second rim spout port 24 and colliding with the stepped portion 40*b* serving as flush water guide portion flows down along the stepped portion 40*b* toward the center of the waste receiving surface 16. Here the stepped portion 40*b* and the well portion 20 side portion ridge line 20*b* are formed to be smoothly continuous, and flush water flowing down along the stepped portion 40*b* flows down into the well portion 20 along the side wall surface 38 on the left side of the well portion 20 (arrow F2 in FIG. 3). Thus the majority of flush water discharged from the second rim spout port 24 flows into the well portion 20 with strong force due to the discharge force and to the gravity force acquired when flowing down (dropping) along the stepped portion 40*b*. The large volume of flush water flowing into the well portion 20 at high force induces a strong vertical circulating flow in the accumulated water inside the well portion 20. Flush water spouted in a liquid membrane form from the second rim spout port 24 serving as liquid membrane spouting portion and guided into the well portion 20 by the flush water guide portion (stepped portion 40*b*) can effectively cancel out the horizontal circulating flow component more than the common linear type of flush water spouted from the first rim spout port 22, forming a strong horizontal circulating flow. Waste which had been floating in the well portion 20 is thus strongly submerged and efficiently discharged through the discharge trap pipe 12.

Figure 10:
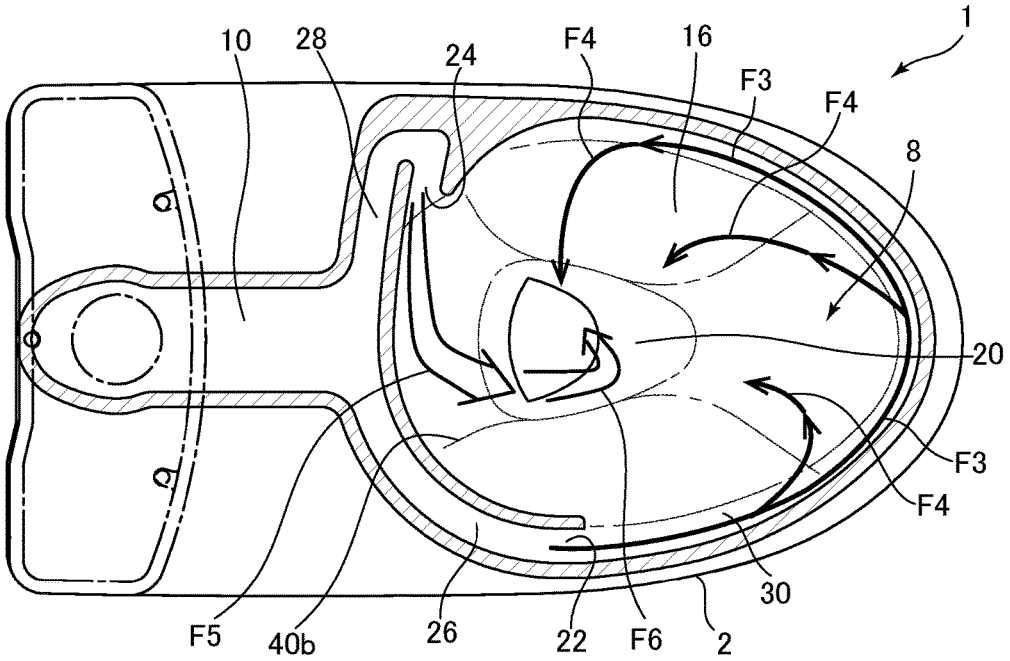
Figure 11:
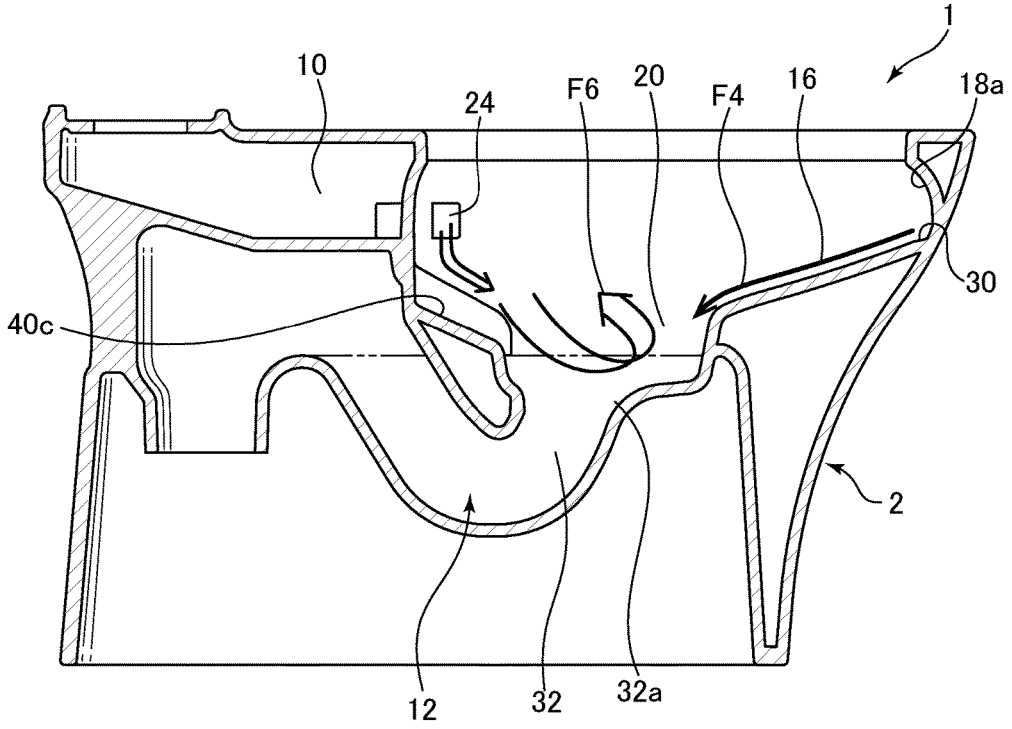

Next, referring primarily to FIGS. 10 and 11, we explain the flush action in a flush toilet 1 according to the embodiment. FIG. 10 is a simplified plan view showing the appearance of the flush water flow in a flush toilet according to an embodiment of the invention; FIG. 11 is a simplified cross section showing the appearance of flush water flow in a toilet according to an embodiment of the invention.

First, when a user turns on an operating switch (not shown), the discharge port (not shown) in the reservoir tank opens, flush water flows into the shared water passageway 10 on the toilet main body 2, and passes through the first water passageway 26 and second water passageway 28 branching from this shared water passageway 10 to be spouted from the first rim spout port 22 and the second rim spout port 24, respectively.

Flush water spouted from the first rim spout port 22 flows first toward the front along the water conduit 30 formed on the inside circumference of the bowl portion 8 rim portion 18, passing over the front end of the bowl portion 8, then forms a horizontal circulating flow which flows toward the rear (FIG. 10, arrow F3). At this point, part of the flush water drops toward the center of the bowl portion 8 as it circulates (FIG. 10, FIG. 11, arrow F4), flushing the waste receiving surface 16. Flush water is also spouted from the second rim spout port 24, and the majority of that collides with the stepped portion 40*b* (flush water guide portion) opposed to the second rim spout port 24 (FIG. 10, arrow F5). Flush water colliding with the stepped portion 40*b* drops along the side wall surface 38 on the left side of the well portion 20 disposed to smoothly continue from the sloped surface forming this stepped portion 40*b*, into the accumulated water in the well portion 20. Flush water flowing into the well portion 20 induces a vertical circulating flow (FIG. 10, FIG. 11, arrow F6) in the accumulated water inside the well portion 20, submerging waste that had been floating in the accumulated water; the submerged waste is then discharged from the discharge trap pipe 12 through the introducing pipe 32 inlet 32*a*.

In a flush toilet according to an embodiment of the invention, flush water discharged as a liquid membrane from the second rim spout port 24 serving as liquid membrane spouting portion collides with the stepped portion 40*b* serving as flush water guide portion and drops into the well portion 20 (FIG. 3), inducing a vertical circulating flow in the accumulated water, therefore waste which had been floating in the accumulated water can be efficiently submerged in the accumulated water, and the floating waste can be effectively discharged from the bowl portion.

Also, in a flush toilet according to the embodiment, the stepped portion 40*b* (flush water guide portion) is smoothly continuous with the well portion 20 side portion ridge line 20*b* (FIG. 3), therefore flush water colliding with the stepped portion 40*b* can be efficiently made to flow into the well portion 20, and a strong vertical circulating flow can be induced in the well portion 20 without major loss of the force of flush water discharged from the second rim spout port 24 (the liquid membrane spouting portion).

In addition, using the flush toilet of the present embodiment, a concave portion 40 connected to the well portion 20 at the rear portion of the waste receiving surface 16 is formed, and one end (the stepped portion 40*b*) of this concave portion 40 functions as a flush water guide portion, therefore flush water colliding with the stepped portion 40*b* immediately drops into the concave portion 40 and flows into the well portion 20 connected to the concave portion 40. Therefore the majority of flush water discharged as a liquid membrane from the second rim spout port 24 can be made to flow into the well portion over a relatively short path, and a strong vertical circulating flow can be induced in the well portion.

Also, using the flush toilet of the present embodiment the concave portion 40 is formed from the well portion 20 to the rear end of the bowl portion 8, therefore flush water which has flowed along the rear end of the bowl portion 8 collides with one end portion of the concave portion 40 (stepped portion 40*b*) and drops into the concave portion 40. As a result, the majority of flush water discharged in a liquid membrane form from the second rim spout port 24 can be made to flow into the well portion 20 by the stepped portion 40*b*, and can induce a strong vertical circulating flow within the well portion 20.

In addition, using the flush toilet of the present embodiment, an approximately fan-shaped form is formed in which the width of the concave portion 40 broadens toward the rear of the bowl portion 8, therefore much of the flush water discharged in a liquid membrane form from the second rim spout port 24 and flowing to the rear portion of the bowl portion 8 can be collected in the concave portion 40, and the collected flush water can be made to flow in a concentrated manner into the well portion 20. As a result, a vertical circulating flow can be induced in the well portion 20, and waste floating in the accumulated water can be submerged and discharged.

Using the flush toilet of the present embodiment, the second rim spout port 24 forms flush water into a liquid membrane shape by discharging it along a descending surface 42 descending in the direction of flush water discharge, therefore discharged flush water can be efficiently placed in a liquid membrane state. Liquid membrane-shaped flush water is capable of inducing a strong vertical circulating flow upon flowing into the well portion 20, so that waste floating in the accumulated water can be submerged and discharged.

In addition, using the flush toilet of the present embodiment, the second rim spout port 24 and the stepped portion 40*b* are disposed in opposition on the left and right at the rear of the bowl portion 8, therefore flush water discharged from the second rim spout port 24 collides at close range with the stepped portion 40*b* (the flush water guide portion). Flush water discharged from the second rim spout port 24 therefore flows into the well portion 20 with the strong discharge force essentially maintained. As a result, a vertical circulating flow can be induced in the well portion 20, and waste floating in the accumulated water can be submerged and discharged.

Also, using the flush toilet of the present embodiment, the second rim spout port 24 is disposed on the inside of the region in which the waste receiving surface 16 concave portion 40 is formed, therefore the majority of flush water discharged from the second rim spout port 24 can be dropped into the concave portion 40, and flush water which has fallen into the concave portion 40 can be made to flow into the well portion 20 by the stepped portion 40*b*. A large volume of flush water can thus be made to flow into the well portion 20 at once, so that a strong vertical circulating flow is induced in the well portion 20, and waste floating in the accumulated water can be efficiently sunk and discharged.

In addition, using the flush toilet of the present embodiment the first rim spout port 22, which forms a horizontal circulating flow on the waste receiving surface 16 with discharged flush water, is provided separately from the second rim spout port 24, therefore waste adhering to the waste receiving surface 16 can be effectively washed off, and the entire bowl portion 8 can be effectively flushed.

We have explained above a preferred embodiment of the invention above, but several variations can be added to the above-described embodiment. In particular, in the above-described embodiment the invention was applied to a wash-down type of flush toilet, but it may also be applied to siphon toilets, or to siphon jet flush toilets with a jet port.

EXPLANATION OF REFERENCE NUMERALS

1: flush toilet
2: toilet main body
3: skirt portion
8: bowl portion
10: shared water passageway
12: discharge trap pipe
16: waste receiving surface
18: rim portion
18*a*: inside circumferential surface
20: well portion
20*a*, 20*b*: side portion ridge lines
20*c*: rear portion ridge line
22: first rim spout port (rim spout portion)
24: second rim spout port (liquid membrane spout portion)
26: first water passageway
28: second water passageway
30: water conduit
32: introducing pipe
32*a*: inlet
34*a*: ascending pipe path
34*b*: descending pipe path
36: bottom surface
38: side wall surface
40: concave portion
40*a*: stepped portion
40*b*: stepped portion (flush water guide portion)
40*c*: bottom surface
42: downward sloped surface

The invention claimed is:

1. A flush toilet flushed by flush water and discharging waste, comprising:

a bowl portion including a bowl-shaped waste receiving surface, a rim portion formed on an upper portion of the waste receiving surface, and a well portion formed below the waste receiving surface for storing an accumulated water;

a discharge trap pipe connected so as to communicate with a bottom portion of the well portion, thereby discharging the flush water and the waste;

a flush water guide portion formed on the waste receiving surface at a rear of the well portion so that the flush water supplied to the bowl portion is guided toward a side wall surface on an inside of the well portion; and a liquid membrane spouting portion formed on the rim portion;

wherein the waste receiving surface has a concave portion which is formed in a rear portion of the waste receiving surface at the rear of the well portion and is connected to the well portion;

wherein one of end portions of the concave portion forms a stepped portion radially extending from the well portion and serving as the flush water guide portion, and a ridge line of the stepped portion is smoothly continuous with a ridge line of the well portion;

wherein the liquid membrane spouting portion discharges the flush water in a liquid membrane form so that the discharged flush water collides with the stepped portion to induce a vertical circulating flow in the accumulated water of the well portion, by dropping the flush water along the side wall surface of the well portion; and wherein the liquid membrane spouting portion forms the flush water into the liquid membrane form by discharging the supplied flush water to follow a downward sloped surface descending downward in the direction of the flush water discharged from the liquid membrane spouting portion.

2. The flush toilet of claim 1, wherein the flush water guide portion is configured such that a slope of the stepped portion in a circumferential direction of the waste receiving surface is most gradual in an outermost circumference of the waste receiving surface, and becomes steep as it approaches the well portion.

3. The flush toilet of claim 1, wherein the flush water guide portion is configured such that a step difference of the stepped portion is smallest at the outermost circumference of the waste receiving surface, and is largest approaching the well portion.

4. The flush toilet of claim 1, wherein the concave portion formed in the waste receiving surface lies from the well portion of the bowl portion to a rear end of the bowl portion.

5. The flush toilet of claim 1, wherein the concave portion formed in the waste receiving surface has approximately a fan shape, broadening toward the rear of the bowl portion.

6. The flush toilet of claim 1, wherein the liquid membrane spouting portion is disposed at the rear of the bowl portion so as to oppose the flush water guide portion.

7. The flush toilet of claim 1, wherein the liquid membrane spouting portion is disposed on the inside of a region in which the concave portion of the waste receiving surface is formed.

8. The flush toilet of claim 1 further comprising a rim spout portion disposed on the rim portion, wherein the rim spout portion discharges the flush water to form a horizontal circulating flow on the waste receiving surface.

* * * * *